US005580278A

United States Patent [19]

Fowler et al.

[11] Patent Number: 5,580,278

[45] Date of Patent: Dec. 3, 1996

[54] GROUNDING AND ANTIDECOUPLING BACKSHELL INTERFACE FOR ELECTRICAL CONNECTORS

[75] Inventors: Clifford C. Fowler, Chatsworth; Rodney L. Painter, Tujunga, both of Calif.

[73] Assignee: Glenair, Inc., Glendale, Calif.

[21] Appl. No.: 317,725

[22] Filed: Oct. 4, 1994

[51] Int. Cl.[6] ..... H01R 13/648

[52] U.S. Cl. ..... 439/609; 439/321

[58] Field of Search ..... 439/92, 95, 108, 439/607, 609, 610, 320, 321, 322, 323, 315, 316, 318

[56] References Cited

U.S. PATENT DOCUMENTS

| | | | |
|---|---|---|---|
| 3,466,590 | 9/1969 | Sylvester | 439/609 |
| 3,869,186 | 3/1975 | Vetter | 439/321 |
| 3,917,373 | 11/1975 | Peterson | 439/321 |
| 4,074,927 | 2/1978 | Ball . | |
| 4,106,839 | 8/1978 | Cooper | 439/609 |
| 4,109,990 | 8/1978 | Waldron et al. | 439/321 |
| 4,255,008 | 3/1981 | Snyder et al. . | |
| 4,268,103 | 5/1981 | Schildkraut et al. | 439/321 |
| 4,291,933 | 9/1981 | Kakaris | 439/321 |
| 4,597,621 | 7/1986 | Burns . | |
| 4,603,934 | 8/1986 | Burns . | |
| 4,746,303 | 5/1988 | Cobraiville et al. | 439/321 |
| 4,793,821 | 12/1988 | Fowler et al. | 439/321 |
| 4,808,117 | 2/1989 | Gale et al. | 439/192 |
| 4,820,184 | 4/1989 | Brandes | 439/321 |
| 4,834,667 | 5/1989 | Fowler et al. | 439/321 |
| 4,900,260 | 2/1990 | Drogo | 439/321 |
| 5,082,454 | 1/1992 | Tonkiss et al. | 439/320 |
| 5,131,695 | 7/1992 | Wiser | 285/354 |
| 5,145,394 | 9/1992 | Hager | 439/321 |
| 5,192,219 | 3/1993 | Fowler et al. | 439/321 |
| 5,211,576 | 5/1993 | Tonkin et al. | 439/462 |

OTHER PUBLICATIONS

Parker Fluid connectors, catalog 4480, May, 1980.
Parker Fluid connectors, Bulletin #4480 B–1, May, 1980.
Parker Fluid connectors, Bulletin 4460–B1, 9 Sep., 1978.
Parker Fluid connectors, Bulletin 4480 B4, May 1980.
Series 72 & 74 Convoluted Tubing and Series 75 Flexible Metal Line conduit, 1992 Glenair, Inc.

*Primary Examiner*—Hien D. Vu
*Attorney, Agent, or Firm*—Fitch, Even, Tabin & Flannery

[57] ABSTRACT

An accessory for an electrical connector, known as a backshell adapter assembly, includes a coupling nut and a generally tubular adapter body. The adapter body is axially secured relative to the coupling nut without the use of a retaining ring by flaring one end of the coupling nut and forming an annular shoulder about the inner circumference of the flared end. The annular shoulder formed on the flared end of the coupling nut cooperates with an annular shoulder formed on the adapter body to provide axial securement of the coupling nut relative to the adapter body once the flared end is crimped. An important aspect of the invention is that the backshell adapter assembly can be used as a stand-alone device or can be used with one or more accessories, such as a grounding spring and an antidecoupling ring for custom applications. In addition, the backshell adapter assembly enables optional features, such as a grounding spring and/or an antidecoupling ring to be installed or removed after the coupling nut is assembled to the adapter body.

12 Claims, 7 Drawing Sheets

GROUNDING AND ANTIDECOUPLING BACKSHELL INTERFACE FOR ELECTRICAL CONNECTORS

BACKGROUND OF THE INVENTION

1. Field of the Invention

The present invention relates to an accessory for an electrical connector, often referred to as a backshell adapter assembly, and more particularly to a backshell adapter assembly, which includes a coupling nut and an adapter body which obviates the need for a retaining ring to axially secure the coupling nut relative to the tubular member, which can be used as a stand-alone device or with one or more accessories including an optional grounding ring and/or an optional antidecoupling ring for selectively preventing rotation of the coupling nut relative to the adapter body.

2. Description of the Prior Art

Backshell adapter assemblies are generally known in the art. Such backshell adapter assemblies normally provide a transition from a plurality of electrical conductors to an electrical connector. Examples of such backshell adapter assemblies are disclosed in U.S. Pat. Nos. 4,074,927; 4,255,008; 4,597,621; 4,603,934; 4,746,303; 4,793,821; 4,808,117; 4,820,184; 4,834,667; 4,900,260; 5,082,454; and 5,192,219.

Various types of backshell adapter assemblies are known, configured to provide a relatively wide range of options, depending on the particular application, such as radio frequency interference (RFI) shielding and antidecoupling. Unfortunately, such options have been known to require custom parts. For example, U.S. Pat. No. 5,192,219 discloses a backshell adapter assembly which includes an antirotation ring which provides for selective engagement of an antidecoupling feature. Unfortunately, such a configuration requires a custom coupling nut which drives up the manufacturing cost for backshell adapter assemblies with optional features.

Known backshell adapter assemblies normally include an adapter body, normally tubular in shape, and a coupling nut. In order to secure the coupling nut relative to the adapter body in an axial direction, a retaining ring is normally used. The retaining ring further adds to the part count of the backshell adapter assembly, which increases the cost of the product, as well as increases the assembly time.

Another problem with known backshell adapter assemblies is that options normally cannot be added after assembly of the adapter body to the coupling nut. In addition, options such as grounding springs and antidecoupling members in known backshell adapter assemblies are not known to be able to be repaired after the backshell adapter is assembled. Thus, failure of a grounding spring or other optional part after assembly necessitates replacement of the backshell adapter assembly.

SUMMARY OF THE INVENTION

It is an object of the present invention to solve various problems associated with the prior art.

It is another object of the present invention to provide a backshell adapter assembly which can be used as a stand-alone device, or alternatively, with one or more optional features for custom applications.

It is yet another object of the present invention to provide a backshell adapter assembly which has fewer parts than known backshell adapter assemblies.

It is yet a further object of the present invention to provide a backshell adapter assembly which obviates the need for a retaining ring in order to provide axial securement of the coupling nut relative to the adapter body.

It is yet a further object of the present invention to provide a backshell adapter assembly which allows optional components to be repaired without disassembly of the backshell adapter.

It is yet a further object of the present invention to provide a backshell adapter assembly which enables optional features, such as a grounding spring and an antidecoupling ring, to be installed after the coupling nut is assembled to the adapter body.

Briefly, the present invention relates an accessory for an electrical connector, known as a backshell adapter assembly, which includes a coupling nut and a generally tubular adapter body. The adapter body is axially secured relative to the coupling nut without the use of a retaining ring by flaring one end of the coupling nut and forming an annular shoulder about the inner circumference of the flared end. The annular shoulder formed on the flared end of the coupling nut cooperates with an annular shoulder formed on the adapter body to provide axial securement of the coupling nut relative to the adapter body once the flared end is crimped. An important aspect of the invention is that the backshell adapter assembly can be used as a stand-alone device or can be used with one or more accessories, such as a grounding spring and an antidecoupling ring for custom applications. In addition, the backshell adapter assembly enables optional features, such as a grounding spring and/or an antidecoupling ring to be installed or removed after the coupling nut is assembled to the adapter body.

BRIEF DESCRIPTION OF THE DRAWING

These and other objects of the present invention will be readily understood with reference to the following specification and attached drawing, wherein.

DETAILED DESCRIPTION OF THE PREFERRED EMBODIMENT

Figure 1:
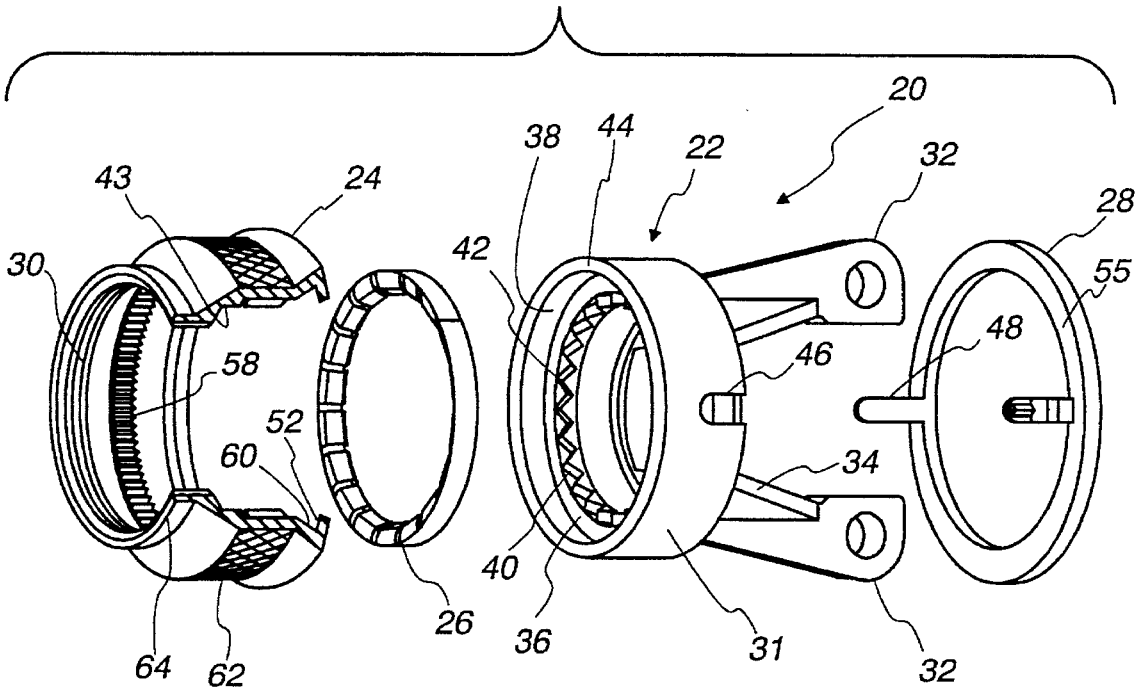
FIG. 1 is an exploded perspective view of a backshell adapter assembly in accordance with the present invention.

Referring to FIG. 1, an exploded perspective view of the backshell adapter assembly in accordance with the present invention is illustrated. The backshell adapter assembly, generally identified with the reference numeral 20, includes an adapter body 22, which may be formed as a generally tubular body, and a coupling nut 24. As will be described in more detail below, the coupling nut 24 is adapted to be axially secured to the adapter body 22 without the use of a retaining ring, thus facilitating manufacturing of the backshell adapter assembly 20 and reducing the cost. Another important aspect of the invention is that the adapter body 22 and coupling nut 24 may be used as a stand-alone device where custom features are not required or may be used with one or more optional members, such as a grounding spring 26 and an antidecoupling ring 28.

The use of accessories depends on the application. The grounding spring 26 is required in applications where a continuous electrical ground path is required between the adapter body 22 and an electrical connector (not shown), normally secured to a threaded portion 30 of the coupling nut 24, to provide RFI shielding. The antidecoupling ring 28 is another custom feature which may be used with the backshell adapter assembly 20, either with or without the grounding spring 26 to prevent rotation of the adapter body 22 relative to the coupling nut 24. As will be discussed in more detail below, the antidecoupling ring 28 is adapted to provide selective antidecoupling of the adapter body 22 relative to the coupling nut 24.

It is to be understood by those of ordinary skill in the art that the adapter body 22 illustrated in the drawings and described herein is merely exemplary. As shown, the adapter body 22 is formed with a tubular portion 31 having a pair of axially extending legs 32, which may be additionally secured to the tubular portion 31 by one or more gusset plates 34. It will be understood that the principles of the present invention are basically applicable to virtually any adapter body having a tubular portion 31.

Figure 2:
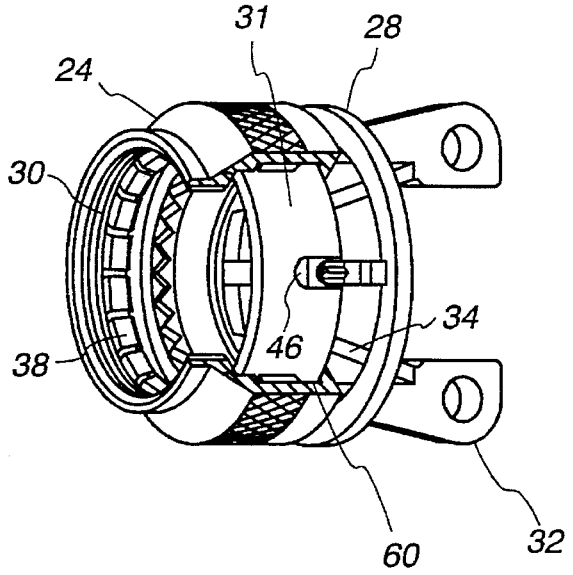
FIG. 2 is a perspective view of the backshell adapter assembly illustrated in FIG. 1, assembled and partially cut away, illustrating a portion of an antidecoupling ring in accordance with the present invention.

The tubular portion 31 is formed with an outer diameter sized to fit within one end of the coupling nut 24 as shown in FIG. 2. An annular shoulder 36 is formed within the tubular portion 31, slightly recessed from the end. The annular shoulder 36 forms an axial seat for the grounding spring 26 and defines a grounding surface portion 38 on the interior of the tubular portion 31 for the grounding spring 26. As shown, the grounding surface portion 38 is formed as a continuous annular wall, forming a radial seat for the grounding spring 26. However, it is also contemplated that the grounding surface portion 38 can be formed from a plurality of discontinuous arcuate wall sections which provide a radial seat for the grounding spring 26.

Disposed concentric relative to the annular shoulder 36 is an electrical connector interface 40, shown formed from a plurality of axially extending teeth 42 formed in a continuous ring. It should be understood that the electrical connector interface 40 is exemplary and that the present principles of the present invention are applicable to other known types of electrical connector interfaces.

The tubular portion 31 of the adapter body 22 axially seats against an annular shoulder 43, formed on the interior of the coupling nut 24, and limits axial movement of the tubular portion 31 relative to the coupling nut 24 in one direction. In particular, an edge 44 of the annular wall forming the grounding surface portion 38 acts to limit axial movement of the adapter body 22 in the direction of insertion into the coupling nut 24.

Figure 3:
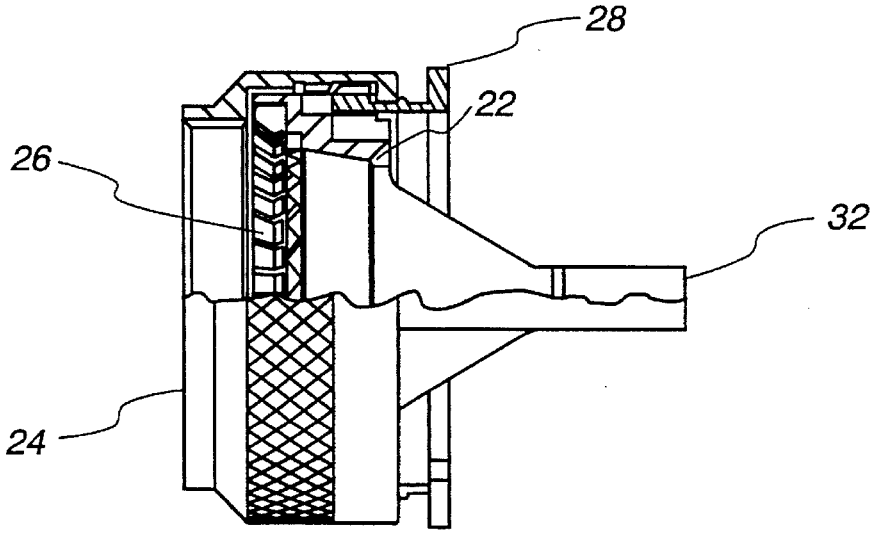
FIG. 3 is an elevational view of the backshell adapter assembly rotated axially 90° relative to FIG. 1, illustrating a grounding spring and antidecoupling ring in accordance with the present invention, shown with the antidecoupling ring in a disengaged position.
Figure 4:
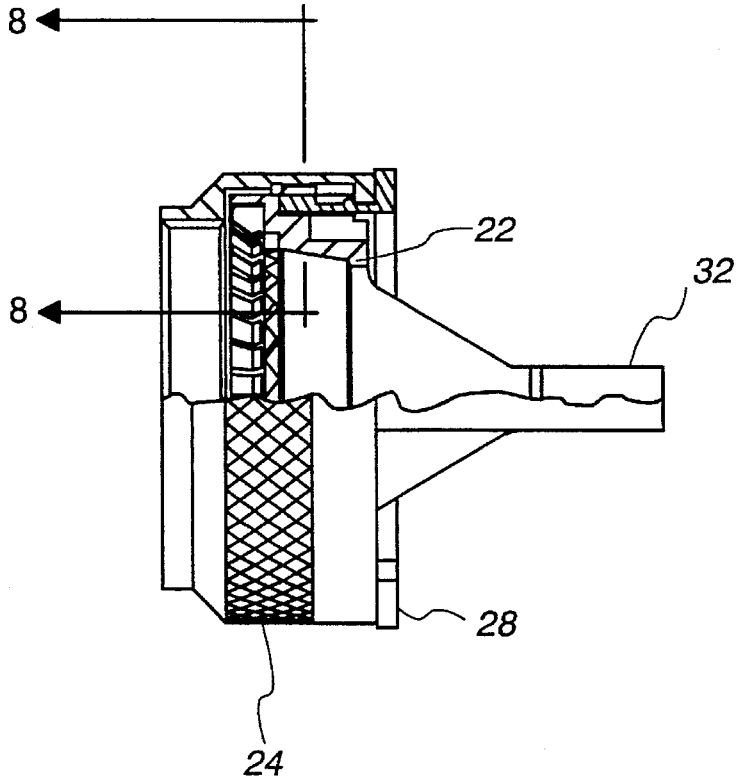
FIG. 4 is similar to FIG. 3, illustrating the antidecoupling ring in an engaged position.
Figure 7:
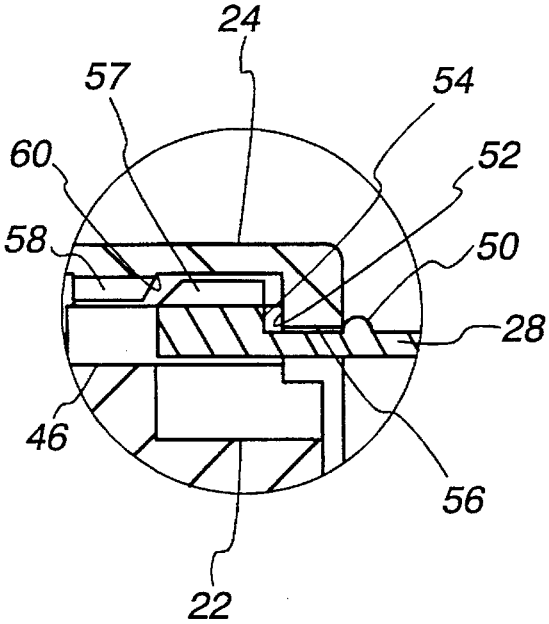
FIG. 7 is an enlarged partial sectional view of an encircled portion of the backshell adapter assembly illustrated in FIG. 3, illustrating the position of an axial positioning detent when the antidecoupling ring is in a disengage position in accordance with the present invention.
Figure 8:
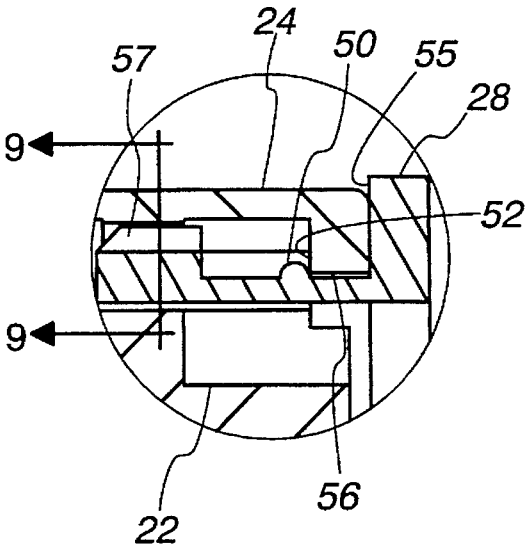
FIG. 8 is an enlarged partial sectional view of the encircled portion of the backshell adapter assembly illustrated in FIG. 4, taken along line 8—8 of FIG. 4, illustrating the position of the axial detent when the antidecoupling ring is in an engage position.

The tubular portion 31 of the adapter body 22 is adapted to slidably carry the antidecoupling ring 28 to permit axial movement of the antidecoupling ring 28 from a disengaged position as shown in FIG. 3 to an engaged position as shown in FIG. 4. In particular, the tubular portion 31 is formed with one or more slots 46 on the exterior circumference thereof for receiving axially extending finger portions 48, formed on the antidecoupling ring 28. As best shown in FIGS. 7 and 8, the extending finger portions 48 of the antidecoupling ring 28 are formed with an axial positioning detent 50 facing radially outwardly. The axial positioning detent 50 is adapted to position the antidecoupling ring 28 relative to an annular shoulder portion 52 formed on one end of the coupling nut 24. FIG. 7 shows the antidecoupling ring 28 in a disengage position. In this position the axial positioning detent 50 is disposed outwardly relative to the coupling nut 24. A shoulder portion 54, formed adjacent one end of the axially extending finger portions 48 of the antidecoupling ring 28, cooperates with the annular shoulder portion 52 formed in the coupling nut 24 to prevent inadvertent removal of the antidecoupling ring 28 during movement toward a disengaged position as shown, for example in FIGS. 2 and 7. In an engage position as shown in FIG. 8, the axial positioning detent 50 cooperates with a base portion 55 of the antidecoupling ring 28 to capture a radially inward facing annular rib 56, formed in one end of the coupling nut 24. In this position the axial positioning detent 50 maintains the base portion 55 of the antidecoupling ring 28 in a position seated against the annular rib portion 56 of the coupling nut 24 to prevent axial movement of the antidecoupling ring 28 after it has been placed in an engaged position as shown, for example in FIG. 2.

Figure 9:
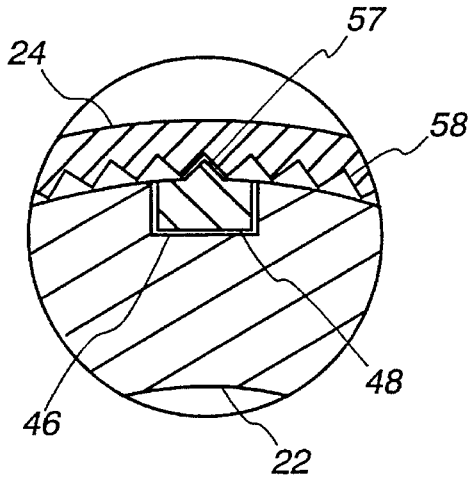
FIG. 9 is an enlarged partial sectional view taken along the line 9—9 of FIG. 8, illustrating the antidecoupling feature in an engage position.
Figure 11:
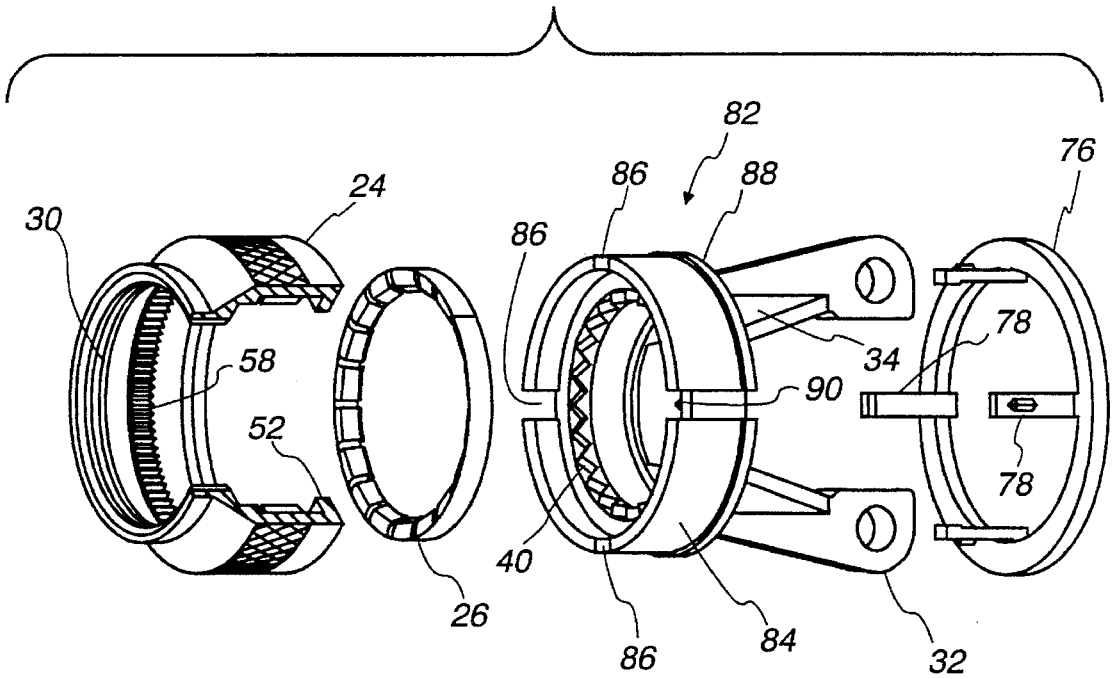
FIG. 11 is an exploded perspective view of an alternate embodiment of a backshell adapter assembly, assembled and partially cut away, in accordance with the present invention.
Figure 12:
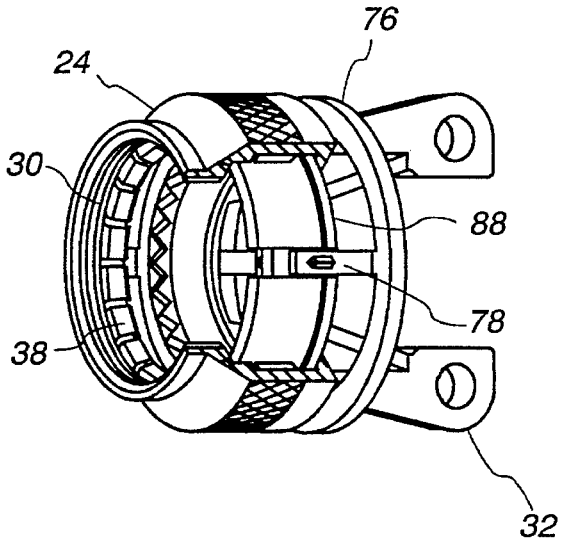
FIG. 12 is a perspective view of the backshell adapter assembly shown in FIG. 11, shown with the antidecoupling ring in a disengaged position.
Figure 13:
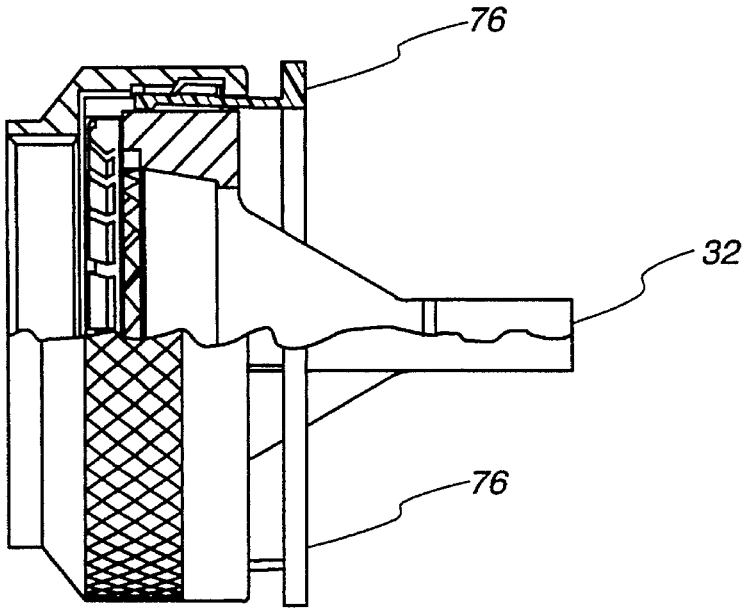
FIG. 13 is an elevational view of the backshell adapter assembly rotated axially 90° relative to FIG. 11, illustrating a grounding spring and antidecoupling ring in accordance with the present invention, shown with the antidecoupling ring in a disengaged position.
Figure 14:
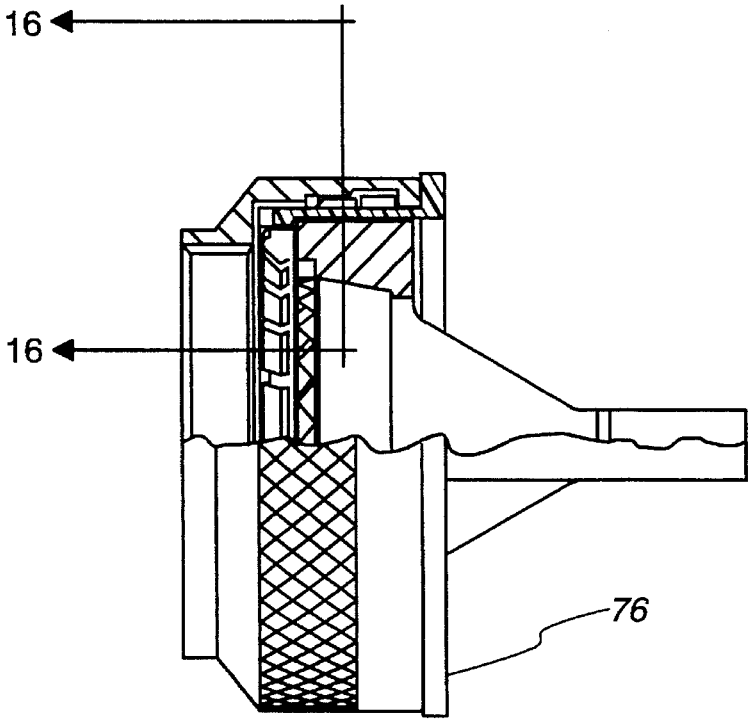
FIG. 14 is similar to FIG. 13 illustrating the antidecoupling ring in an engage position.

As shown, the antidecoupling ring 28 is formed as a ring-like member (continuous as shown in FIG. 11 or partial as shown in FIG. 1) formed with diametrically opposed extending finger portions 48. As mentioned above, the extending finger portions 48 are received in slots 46 formed in the tubular portion 31 of the adapter body 22. The extending finger portions 48 are formed with an antirotation tooth 57, extending radially outwardly and formed adjacent the shoulder portion 54. As illustrated best in FIG. 9 below, the antirotation tooth 57 on each of the extending finger portions 48 of the antidecoupling ring 28 are adapted to cooperate with a band of serrations 58 formed in the interior of the coupling nut 24 as shown in FIGS. 1 and 9. In a disengage position as shown in FIGS. 3 and 7, the antirotation tooth 57 is disposed in an annular space 60, formed within the coupling nut 24 to enable rotation of the coupling nut 24 relative to the adapter body 22.

The coupling nut 24 (FIG. 1) is formed as a generally cylindrical ring-like member formed with an annular side wall 62. The inner diameter of the annular side wall 62 is sized to receive a tubular portion 31 of the adapter body 22 and form the annular gap 60 (FIGS. 7 and 15) to receive the antirotation tooth 57 when the antidecoupling ring 28 is in a disengage position. The coupling nut 24 also includes a reduced diameter annular side wall portion 64 which defines the annular shoulder 43 between it and the annular side wall 62. The interior circumference of the annular side wall portion 64 is threaded as mentioned above, forming the interface 30 for receiving an electrical connector (not shown). As mentioned above, the annular shoulder 43, formed on the interior of the coupling nut 24, acts as a seat for the edge 44 of the tubular portion 31 of the adapter body 22 to stop axial movement in a direction of insertion.

An important aspect of the invention relates to the axial securement of the coupling nut 24 and the adapter body 22 without the use of a retaining ring. In particular, as shown in FIG. 1, the free end of the annular side wall 62 of the coupling nut 24 is formed with an annular shoulder portion 52 as discussed above. In order to enable the coupling nut 24 to be assembled to the adapter body 22, the annular side wall 62 is flared out sufficiently to enable the adapter body 22 to be fully seated within the coupling nut 24. After the adapter body 22 is seated within the coupling nut 24 (i.e. the leading edge 44 of the tubular portion 31 of the adapter body 22 is seated against the interior annular shoulder 43 in the coupling nut 24), the flared portion of the annular side wall 62 is crimped, which causes the tubular portion 31 of the adapter body 22 to be captured between the annular shoulder 43 and the annular rib 56 of the coupling nut 24, thus preventing axial movement of the adapter body 22 relative to the coupling nut 24 in either direction.

As should be appreciated by those of ordinary skill in the art, the configuration of the adapter body 22 and the coupling nut 24 enables these components to be assembled into a stand-alone backshell adapter assembly 20 or used with the grounding spring 26 or the antidecoupling ring 28. Thus, the configuration provides for a standardized adapter body 22 and coupling nut 24 which can be used in multiple applications, including those in which a grounding spring 26 is required and/or an antidecoupling ring 28 is required. As such, the manufacturing cost of the backshell adapter assembly is reduced.

Figure 5:
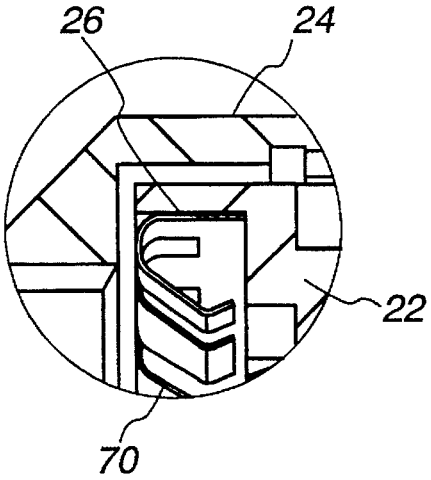
FIG. 5 is a partial enlarged sectional view of the encircled portion of the backshell adapter assembly illustrated in FIG. 3, illustrating one type of a grounding spring that may be used with the backshell adapter assembly in accordance with the present invention.
Figure 6:
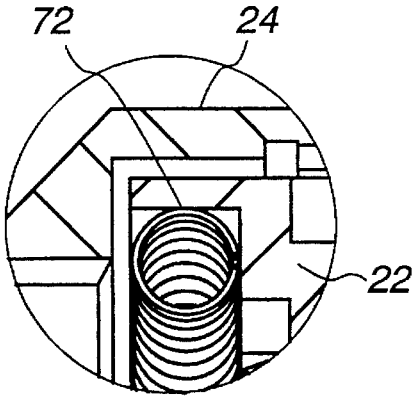
FIG. 6 is similar to FIG. 5, illustrating an alternative grounding spring.
Figure 10:
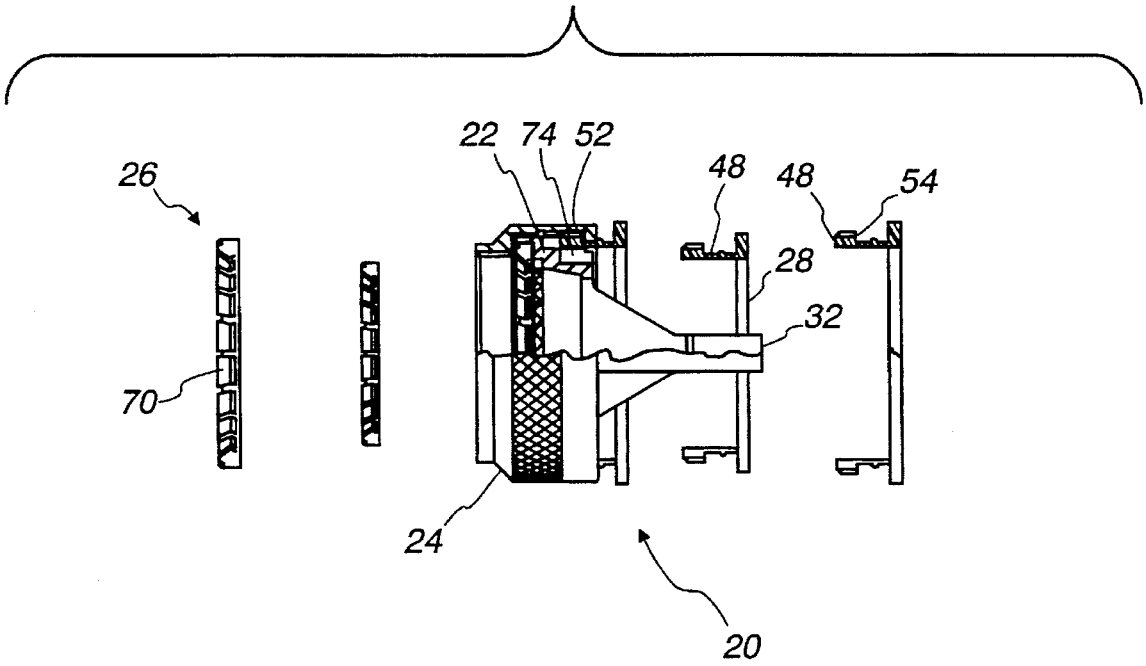
FIG. 10 is an elevational view of the backshell adapter assembly illustrated in FIG. 1 showing the assembly of an antidecoupling ring and a grounding spring in various stages in accordance with the present invention.

Various configurations of the grounding spring 26 are contemplated. For example, as shown in FIGS. 5 and 10, the grounding spring 26 may be stamped from a piece of resilient electrical conducting material and formed to include a plurality of resilient fingers 70. As mentioned above, the spring 26 is then seated in the annular shoulder 36, formed in the interior of the adapter body 22, in order to provide a continuous electrical path between the adapter body 22 and an electrical connector (not shown), normally screwed into the interface 30 in the coupling nut 24. Alternatively, a helical spring 72 can be utilized as shown in FIG. 6 and joined end to end as illustrated in FIG. 1.

Another important aspect of the invention is the ease in which the antidecoupling ring 28 and the grounding spring 26 can be changed after the coupling nut 24 is assembled to the adapter body 22 as discussed above, which facilitates the installation of accessories, such as the antidecoupling ring 28 and the grounding spring 26 after assembly, and also facilitates repairs. As shown in FIG. 10, antidecoupling ring 28 can easily be removed and installed from the front side (i.e. the connector side) of the backshell adapter assembly 20. More particularly, the split configuration of the springs 26 and 72 can be relatively easily removed and installed from the connector end of the backshell adapter assembly 20.

The antidecoupling ring 28 can also be easily removed and replaced after the coupling nut 24 is assembled to the adapter body 22. In particular, the extending fingers 48 of the antidecoupling ring 28, being formed from a resilient material, such as plastic, enable the shoulder portion 54, formed on the extending finger 48 of the antidecoupling ring 28, to clear the annular shoulder portion 52 formed on the coupling nut 24. Such action will cause the shoulder portion 54 on the antidecoupling ring 28 to be disposed in a gap 74 so that the antidecoupling ring 28 can be removed from the backside of the backshell adapter assembly 20. Should any of the extending fingers 48 of the antidecoupling ring 28 break, the broken fingers 48 can be removed by placing the assembly 20 in a position such that the bottom of the assembly 20 faces downward to enable the broken finger 48 to fall out by gravity. In order to install an antidecoupling ring 28 in the assembly 20, the axially extending fingers 48 are bent radially inwardly toward one another while the antidecoupling ring 28 is being axially inserted into the backside of the assembly 20. Once the shoulder portion 54 on the antirotation tooth 57 clears the annular shoulder portion 52 on the coupling nut 24, the resilience of the extending fingers 48 of the antidecoupling ring 28 will force the extending finger portion 48 into the proper position as shown in FIG. 10.

An alternate embodiment of the invention is illustrated in FIGS. 11–16. Like reference numerals are used to identify like parts. The alternate embodiment is similar to the embodiment illustrated in FIGS. 1–10 with the exception of the configuration of axial detents on the antidecoupling ring and adapter body. More particularly, the antidecoupling ring 76 is formed as a ring-like member with axially extending fingers 78. Each axially extending finger 78 is formed with an inwardly facing axial detent 79 and an antirotation tooth 80, disposed radially outwardly. The axial positioning detents 79 are adapted to cooperate with a modified adapter body 82. In this embodiment, the adapter body 82 is formed as a generally tubular member similar to the adapter body 22, except that a tubular wall portion 84 is formed with a plurality of slots 86 which extend the entire width of the annular wall portion 84 as best shown in FIG. 11. In addition, a shoulder 88 is formed about the outer circumference of the adapter body 82. The shoulder 88, along with a shoulder 90 (FIGS. 15 and 16), formed in the interior of the adapter body 82, cooperate with the axial positioning detent 79 to facilitate axial positioning of the antirotation tooth 80 relative to the serrations 58 formed in the coupling nut 24.

Figure 15:
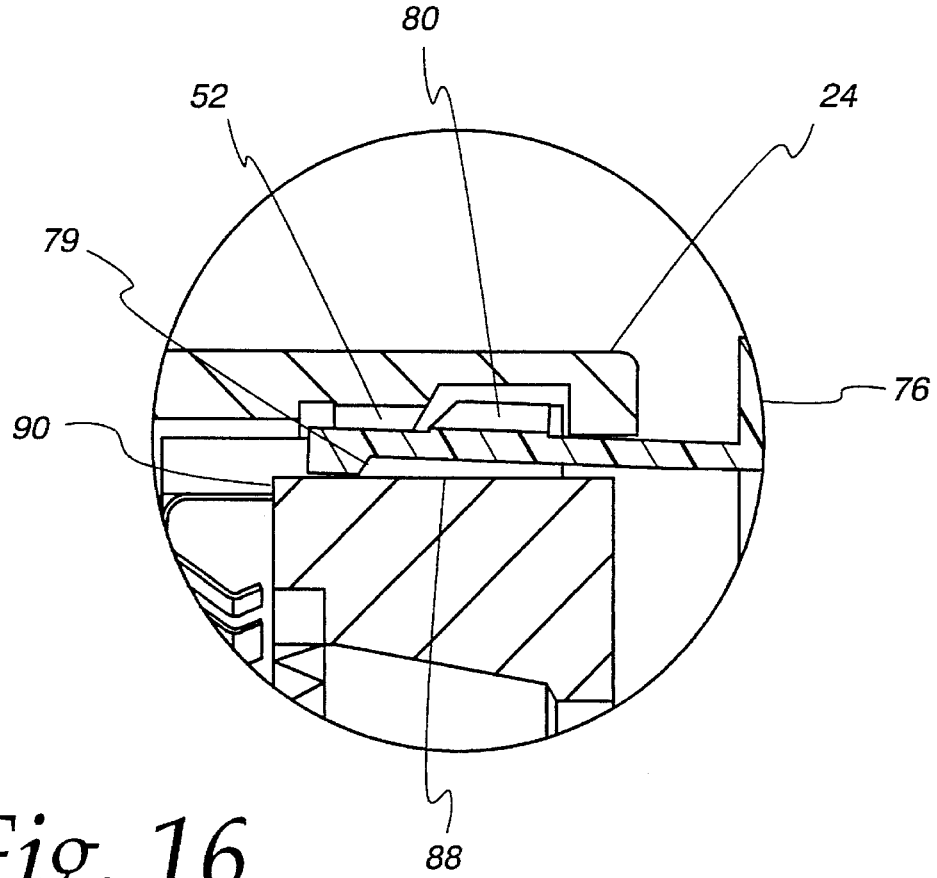
FIG. 15 is an enlarged partial sectional view of the encircled portion of the backshell adapter assembly illustrated in FIG. 13, illustrating the position of an axial positioning detent when the antidecoupling ring is in a disengaged position in accordance with the present invention.
Figure 16:
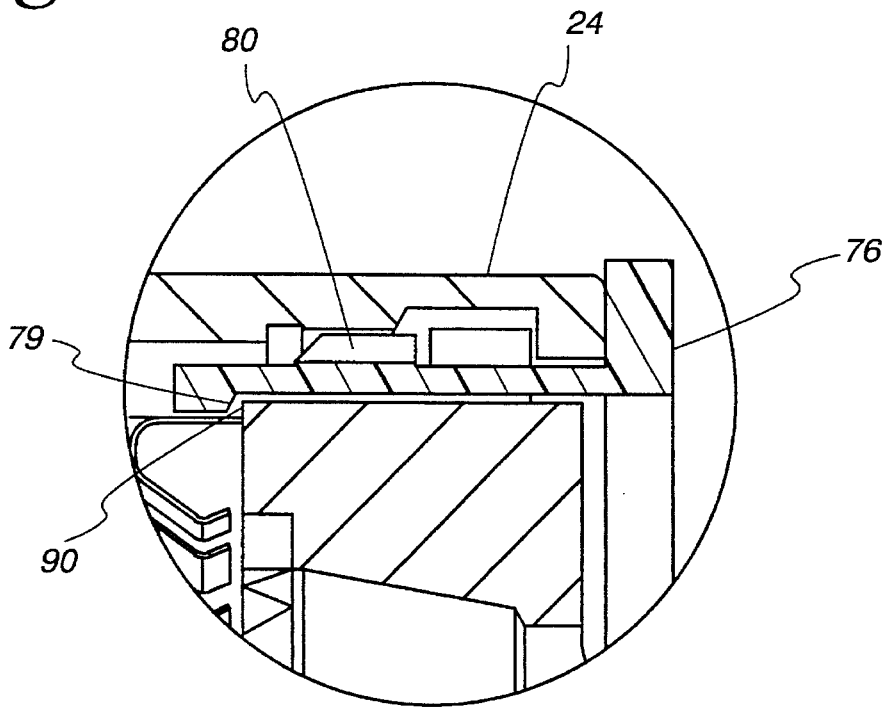
FIG. 16 is an enlarged partial sectional view of the encircled portion of the backshell adapter assembly illustrated in FIG. 14 taken along line 16—16, illustrating the antidecoupling ring in an engage position.

Referring to FIG. 15, the antidecoupling ring 76 is shown in a disengaged position. In this position, the axial positioning detent 79 is disposed against the outside diameter of the shoulder 88 formed on the adapter body 82. Once the antidecoupling ring 76 is placed in an engaged position as shown in FIG. 16, the axial-positioning detent 79 springs into position and captures the shoulder 90 formed in the interior of the adapter body 82. In this position, the antirotation tooth 80 on the extending finger 78 of the antidecoupling ring 76 is in engagement with the serrations 58 on the coupling nut 24.

Obviously, many modifications and variations of the present invention are possible in light of the above teachings. Thus, it is to be understood that, within the scope of the appended claims, the invention may be practiced otherwise than as specifically described above.

What is claimed and desired to be secured by Letters Patent of the U.S. is:

1. A backshell adapter assembly for providing an interface between a plurality of electrical conductors and an electrical connector, electrically coupled to said electrical conductors, the backshell adapter assembly comprising:

a coupling nut formed with an interior annular shoulder adjacent one end thereof and an annular rib on an opposing flared end portion at the other end thereof;

a grounding ring; and an adapter body which includes a generally tubular portion formed with an annular wall, the annular wall formed with a diameter relatively smaller than the diameter of said coupling nut, said adapter body rotatably received in the coupling nut and axially secured thereto and seated against said interior annular shoulder of said coupling nut once the flared end portion of said coupling nut is crimped, thereby capturing said tubular portion of said adapter body between said annular shoulder and said annular rib;

wherein said annular wall forms a radial seat defining a grounding surface, said coupling nut being configured to enable said grounding ring to be seated against said grounding surface and removed from said backshell adapter assembly after said coupling nut and adapter body are assembled to enable said grounding ring to be repaired without disassembly of said backshell adapter assembly.

2. A backshell adapter assembly as recited in claim 1, wherein said grounding ring is a spring.

3. A backshell adapter assembly as recited in claim 2, wherein said grounding spring includes a plurality of resilient finger portions.

4. A backshell adapter assembly as recited in claim 2, wherein said grounding spring is a helical spring.

5. A backshell adapter assembly as recited in claim 1, further including ring means for preventing rotation of said coupling nut relative to said adapter body.

6. A backshell adapter assembly as recited in claim 5, wherein said ring means includes a ring with a radially extending finger.

7. A backshell adapter assembly for providing an interface between a plurality of electrical conductors and an electrical connector, electrically couple to said electrical conductors, the backshell adapter assembly comprising:

a coupling nut formed with an interior annular shoulder adjacent one end thereof and an annular rib on the other end opposite said one end, said coupling also having a longitudinal direction;

an adapter body rotatably received in the coupling nut and axially secured between said annular shoulder and said annular rib, wherein said coupling nut includes a plurality of interior serrations; and an antidecoupling ring formed with at least one finger extending in said longitudinal direction and extending generally perpendicular to said ring, said at least one finger formed with an antirotation tooth, said antidecoupling ring being slidably engaged with said adapter body after said adapter body has been received in said coupling nut to enable the antidecoupling ring to move to an engage position so that said antirotation tooth engages the serration formed in the coupling nut, the antidecoupling ring also adapted to move to a disengaged position so that said antirotation tooth is disengaged from said serrations.

8. A backshell adapter assembly as recited in claim 7, wherein said at least one finger is formed from a resilient material.

9. A backshell adapter assembly as recited in claim 7, wherein said adapter body and coupling nut are configured to enable said antidecoupling ring to be installed after said adapter body is assembled to said coupling nut.

10. A backshell adapter assembly as recited in claim 7, wherein said assembly is configured to enable said antidecoupling ring to be removed after said adapter body is assembled to said coupling nut.

11. A backshell adapter assembly as recited in claim 7, wherein said adapter body is provided with an least one slot to enable said at least one finger of said antidecoupling ring to be received therein when said adapter body is assembled to said coupling nut, said at least one finger move between said engage position and said disengage position.

12. A backshell adapter assembly for providing an interface between a plurality of electrical conductors and an electrical connector, electrically coupled to said electrical conductors, the backshell adapter assembly comprising:

a coupling nut formed with an interior annular shoulder adjacent one end thereof and an annular rib on an opposing end portion at the other end thereof;

a grounding ring; and an adapter body which includes a generally tubular portion formed with an annular wall, the annular wall formed with a diameter relatively smaller than the diameter of said coupling nut, said adapter body rotatably received in the coupling nut and axially secured thereto and seated against said interior annular shoulder of said coupling nut so that said tubular portion of said adapter body is captured between said annular shoulder and said annular rib wherein said annular wall forms a radial seat defining a grounding surface adjacent to front end of said coupling nut, said coupling nut being configured to enable said grounding ring to be seated against said grounding surface and removed from said backshell adapter assembly after said coupling nut and adapter body are assembled to enable said grounding ring to be repaired without disassembly of said backshell adapter assembly.

* * * * *

UNITED STATES PATENT AND TRADEMARK OFFICE

CERTIFICATE OF CORRECTION

PATENT NO. : 5,580,278

DATED : December 3, 1996

INVENTOR(S) : Fowler, et al.

It is certified that error appears in the above-indentified patent and that said Letters Patent is hereby corrected as shown below:

| Col. | Line | |
|---|---|---|
| 8 | 3 | Change "also" to --nut--. |

Signed and Sealed this

Twenty-second Day of April, 1997

Bruce Lehman

BRUCE LEHMAN

*Commissioner of Patents and Trademarks*

*Attest:*

*Attesting Officer*